US006739900B2

(12) United States Patent
Mortun et al.

(10) Patent No.: US 6,739,900 B2
(45) Date of Patent: May 25, 2004

(54) STRAIGHT BLADE PLUG AND CONNECTOR HAVING A VARIABLE POSITION CORD GRIP

(75) Inventors: Sorin I. Mortun, Irvington, NY (US); Thomas J. Vigorito, Fairfield, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/011,435

(22) Filed: Dec. 11, 2001

(65) Prior Publication Data

US 2003/0114042 A1 Jun. 19, 2003

(51) Int. Cl.[7] ..... H01R 13/58
(52) U.S. Cl. ..... 439/469; 439/460
(58) Field of Search ..... 439/469, 460, 439/466, 462, 459

(56) References Cited

U.S. PATENT DOCUMENTS

| | | | | |
|---|---|---|---|---|
| 1,123,187 A | | 12/1914 | Gilson | |
| 2,782,388 A | | 2/1957 | Opalenik et al. | 339/192 |
| 3,402,382 A | | 9/1968 | De Tar | 339/103 |
| 3,437,980 A | | 4/1969 | Smith | 339/103 |
| 3,784,961 A | | 1/1974 | Gartland, Jr. | 339/107 |
| 3,865,461 A | | 2/1975 | Ludwig | 339/103 |
| 4,108,527 A | | 8/1978 | Douty et al. | 339/107 |
| 4,178,056 A | | 12/1979 | Lee | 339/103 |
| 4,213,667 A | | 7/1980 | Wittes | 339/103 |
| 4,460,235 A | | 7/1984 | Gelin | 339/154 |
| 5,021,006 A | | 6/1991 | Fargeaud et al. | 439/469 |
| 5,083,938 A | * | 1/1992 | Poliak | 439/460 |
| 5,217,389 A | | 6/1993 | MacKay et al. | 439/466 |
| 5,338,222 A | | 8/1994 | Boteler | 439/469 |
| 5,354,213 A | | 10/1994 | Hoffman | 439/469 |
| 5,358,429 A | * | 10/1994 | Mina | 439/695 |
| 5,562,483 A | | 10/1996 | Hoffman | 439/469 |
| 5,641,305 A | * | 6/1997 | Lutz et al. | 439/649 |
| 5,641,310 A | | 6/1997 | Tiberio, Jr. | 439/680 |
| 6,007,384 A | | 12/1999 | Kraemer et al. | 439/610 |

FOREIGN PATENT DOCUMENTS

DE 497811 5/1930

* cited by examiner

*Primary Examiner*—Alexander Gilman
(74) *Attorney, Agent, or Firm*—Alfred N. Goodman; Mark S. Bicks

(57) ABSTRACT

An electrical connector, comprising a housing, having a front face with first and second openings therein, the first and second openings receiving first and second electrical prongs, respectively. First and second box terminals are coupled to the housing using first and second fastening members. The first fastening member is inserted into the housing from substantially the same direction as the second fastening member. First and second electrical contacts are at least partially received in the first and second box terminals, respectively, and adapted to couple to the first and second electrical prongs, respectively. A cord grip is coupled to the housing and has an insert. The insert is capable of being adjusted to at least two different positions and thereby allowing electrical cords of differing diameters to be frictionally held by the cord grip. This configuration of electrical connector allows easy, secure assembly, while allowing multiple sized cords to be securely held therein.

21 Claims, 7 Drawing Sheets

STRAIGHT BLADE PLUG AND CONNECTOR HAVING A VARIABLE POSITION CORD GRIP

FIELD OF THE INVENTION

This invention relates to an electrical straight blade plug and connector. More specifically, this invention relates to a straight blade plug and connector having a plug with three box terminals and a cord grip. The box terminals are used to connect the electrical wiring to the plug blades and the cord grip is used to allow the plug to accommodate three different sized cords for versatility. Each box terminal accepts one prong from a single plug and has an assembly screw that can be inserted into a respective box terminal in the same direction as each other screw, facilitating assembly of the plug. The cord grip has a male and female portion and can accommodate three different sized cords by employing and insert that is snap fitted into the female portion, which is rotated and moved up and down depending on the size of the cord such that the cord is held between the insert and the male part of the cord grip. Furthermore, the cord grips have two dovetails on each cord grip for attachment to the plug body that allows the plug to pass UL pull test requirements.

BACKGROUND OF THE INVENTION

Typically, an electrical cord or conduit is coupled within an electrical connector by a movable conduit jaw. An example of such a jaw is disclosed in Gartland U.S. Pat. No. 3,784,961, the disclosure of which is hereby incorporated herein by reference. Such jaws are able to grip and secure only one general size of conduit. However, generally various sizes of conduits are used for different applications.

The conventional means for accommodating a wide range of conduit diameters has been to use a removable or expendable conduit clamp, i.e., one that is used only when smaller diameter cable is used and removed when larger diameter cable is used. The clamp reduces the opening size of the electrical connector, thereby allowing the conduit clamp to effectively grip the smaller diameter cable within the opening.

Such removable clamps have several disadvantages. The electrical connectors leave the factory with the clamps installed and ready to receive smaller diameter conduit. Thus, if the user forgets to remove the clamp or does not realize removal is necessary and attempts to use larger diameter conduit, the conduit may be damaged. Furthermore, removable clamps are easily lost.

Alternatively, clamps that rotate have been used that allow the clamping mechanism to hold two differently sized conduits. For example, in U.S. Pat. No. 5,562,483 to Hoffman, a clamp can be rotated 90 degrees to hold a large diameter cable in one position and a small diameter cable in a second position. However, this device is limited in only two positions for two different sized cables.

Additionally, typically electrical plugs and connectors each have three box terminals, one each for the hot, neutral and ground prongs with each box terminal having a screw that secures the electrical wire therein. In conventional plugs and connectors, the screws are inserted from various directions, thereby requiring the orientation of the plug or connector to be altered during assembly.

Furthermore, many conventional cord grips are merely coupled to the plug or connector housing using conventional means, such as screws. Typically these methods can be inadequate and fail if the wires connected to the plug or connector are pulled. In many cases the cord grip is not secure enough to pass the UL pull test requirements.

Thus, a need exists to provide an improved electrical wiring device with a clamp capable of gripping various sizes of electrical conduit, is easy to assemble and can withstand the UL pull test requirements.

SUMMARY

Accordingly, it is an object of the present invention is to provide an electrical connector having a cord grip that can vary the diameter of cable received therein.

Another object of the present invention to provide an electrical connector having a cord grip that can receive at least three different diameter cables.

Still another object of the present invention is to provide an electrical connector that has three box terminals, each having a screw that inserts therein in the same direction as each other screw, facilitating assembly.

Yet another object of the present invention is to provide an electrical connector having a cord grip that couples to the housing using at least one dove tail type protrusion and groove connection to securely attach the cord grip the housing.

These objects are basically obtained by an electrical connector, comprising a housing having a front face with first and second openings therein, the first and second openings receiving first and second electrical prongs, respectively, first and second box terminals are coupled to the housing using first and second fastening members, the first fastening member being inserted into the housing from substantially the same direction as the second fastening member, first and second electrical contacts at least partially received in the first and second box terminals, respectively, and adapted to couple to the first and second electrical prongs, respectively, and a cord grip coupled to the housing and having an insert, the insert capable of being adjusted to at least two different positions and thereby allowing electrical cords of differing diameters to be frictionally held by the cord grip.

Other objects, advantages, and salient features of the present invention will become apparent to those skilled in the art from the following detailed description, which, when taken in conjunction with the annexed drawings, discloses a preferred embodiment of the invention.

DETAILED DESCRIPTION OF THE PREFERRED EMBODIMENT

Figure 1:
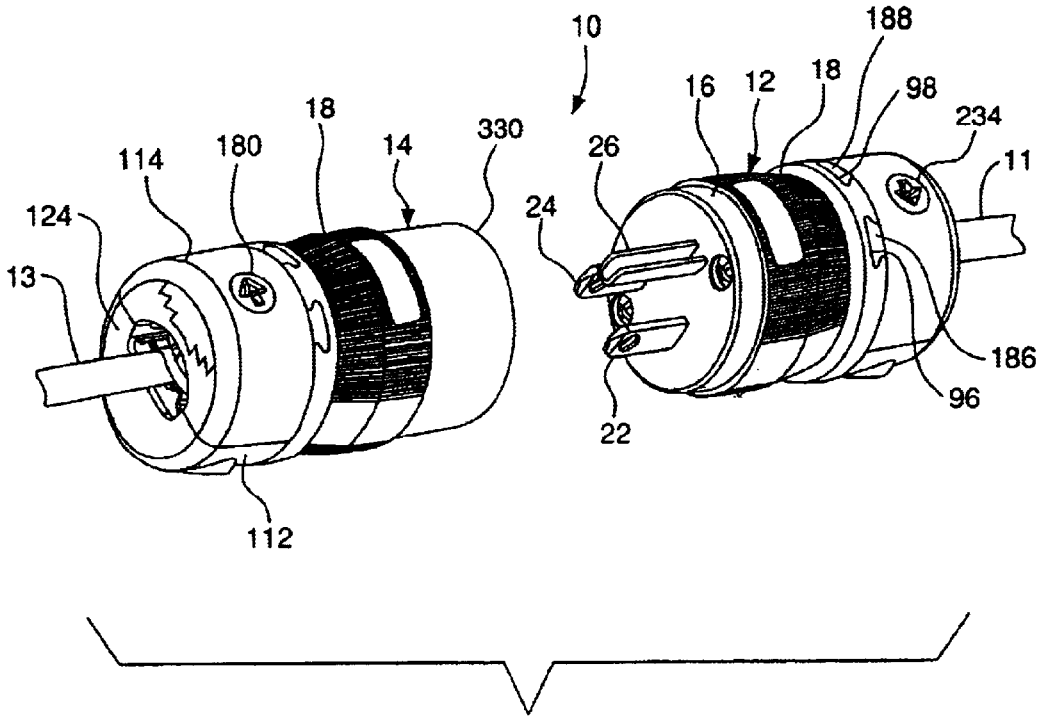
FIG. 1 is a top perspective view of a plug and connector according to a preferred embodiment of the present invention.
Figure 2:
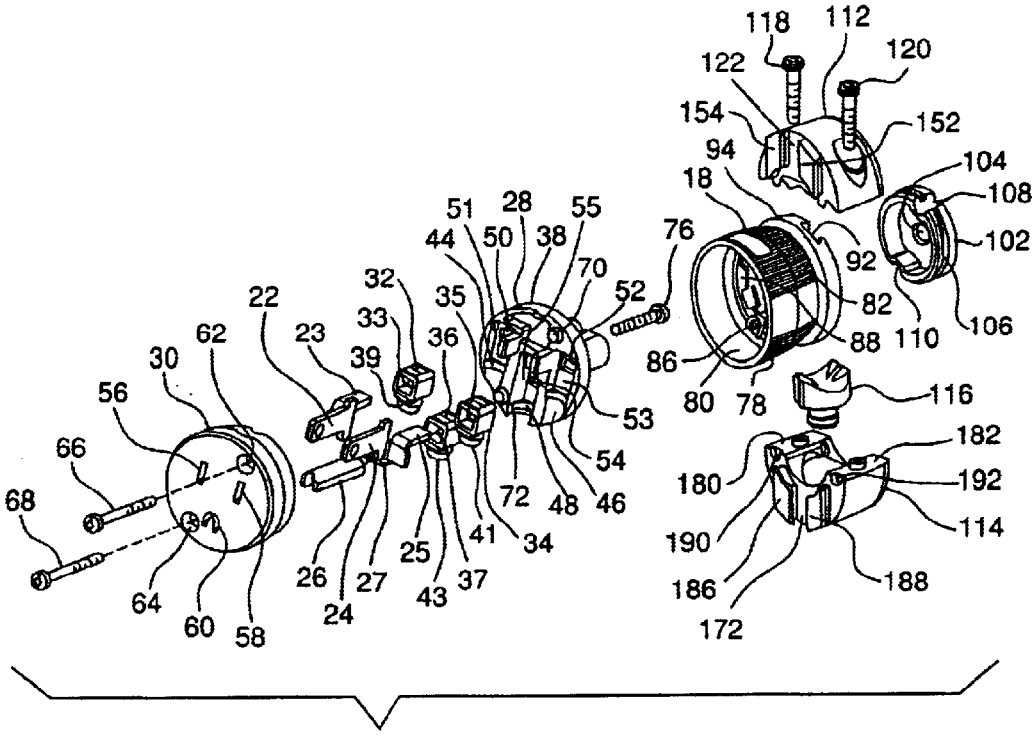
FIG. 2 is an exploded top perspective view of the plug of FIG. 1.
Figure 3:
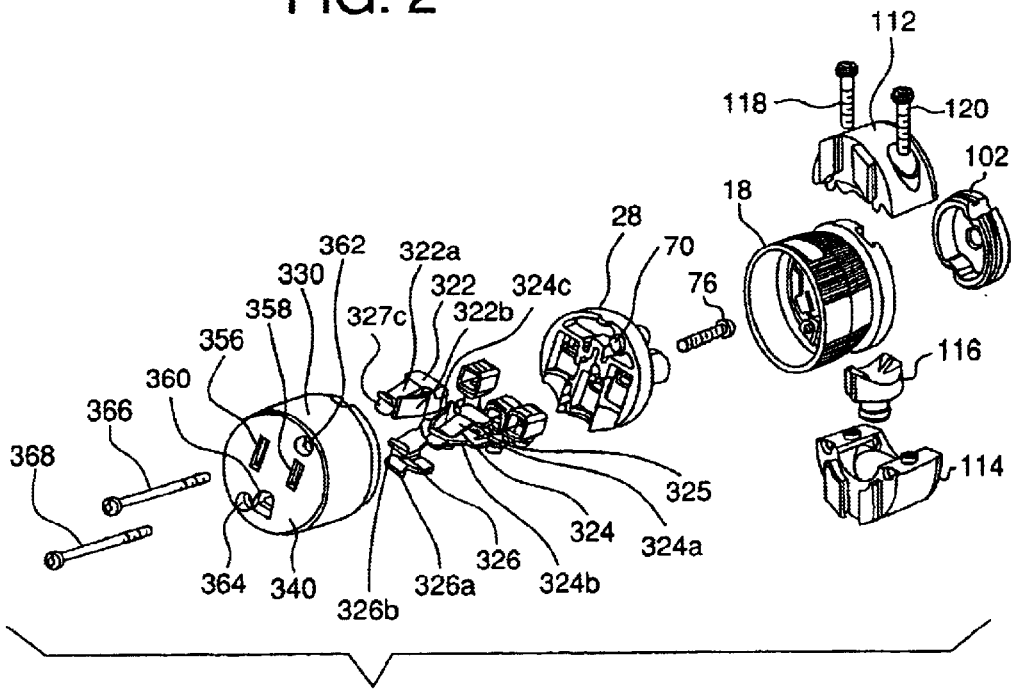
FIG. 3 is an exploded top perspective view of the connector of FIG. 1.

FIGS. 1–3 illustrate an electrical connector 10 in accordance with a preferred embodiment of the present invention. Electrical connector 10 preferably has a straight blade plug 12 and a female connector portion 14, each of which was an electrical wire or cord 11 and 13, respectively, connected thereto.

As seen in FIGS. 1 and 2, plug 12 is preferably generally cylindrical and includes a contact housing or holder 16, a cover 18 and a cord grip 20. Plug 12 is the male half of connector 10, having three electrical prongs 22, 24 and 26 extending therefrom. Electrical prongs 22, 24 and 26 generally are slideably received within the female connector portion 14.

Housing 16 is preferably plastic or any nonconductive material formed by a retaining shell 28 and a blade holder 30. Both shell 28 and holder 30 have substantially cylindrical portions and are the front and the back of housing 16, respectively. Between the shell 28 and holder 30 and held therein are three box terminals 32, 34 and 36 that are coupled to electrical connectors or prongs 22, 24 and 26.

Prongs 22, 24 and 26 are generally known in the art and are preferably metal extensions that conduct electricity from the male portion 12 of the connector into the female portion 14 of the connector. As seen in FIG. 2, prongs 22 and 24 are preferably the neutral and hot conducting members and are substantially rectangular and of conventional size which fit the generally acceptable electrical female connector or outlet. However, prongs 22 and 24 can be any size and shape desired and may be sized and shaped in any manner desire to fit any known, conventional electrical outlet or any custom electrical outlet. Prong 26 is preferably metal and slightly longer than prongs 22 and 24, so that the ground connection is maintained slightly longer. Prong 26 is preferably a grounding member, has U-shaped cross-section and is generally sized and configured to be accepted by a conventional grounding slot in a conventional female connecting portion or outlet. However, as with prongs 22 and 24, prong 26 can be any size and shape desired.

Each prong 22, 24 and 26 is unitary with an extension tab or contact 23, 25 and 27, respectively, that extends backward and substantially transverse or perpendicular to the direction of the prong itself. Each extension tab is substantially rectangular and flat or planar, and is adapted to fit within box terminals 32, 34 and 26, respectively. The contacts and prongs do not necessarily need to be unitary and can be electrically connected in any manner desired, but are preferably at least electrically and mechanically coupled to a respective prong.

Box terminal 32, 34 and 36 are preferably plastic and substantially rectangular boxes, each with an inner and outer wall or surface. The inner surfaces of box terminals 32, 34 and 36 define passageway 33, 35 and 37, respectively, that extends completely through the box terminal. Each passageway is adapted to allow at least part of the protrusion or contact from a respective prong to enter therein. Furthermore, each box terminal has a threaded passageway or aperture extending from the outer surface to the inner surface located at the bottom of the box terminal that is sized and configured to allow a threaded or fastening member 39, 41 and 43, respectively, such as a screw, to be threaded or inserted therein and into a respective passageway. The screw preferably engages or contacts a side of a respective extension tab of a prong and frictionally holds it within a respective passageway, along with one of the protrusions 45, 47 and 49 that extend with the passageways 33, 35 and 37, respectively.

Retaining shell 28 has a substantially circular portion 38 that has three indented portions or grooves 51, 53 and 55 for inserting box terminals 32, 34 and 36, respectively. As seen in FIG. 2, each groove is substantially rectangular and has an arced wall 44, 46 and 48, respectively, at the bottom end thereof. Furthermore, each groove has a hole or passageway 50, 52 and 54, respectively, extending through the back wall to allow passage or an electrical wire (generally hot, neutral or ground) to pass through shell 28 and into a respective box terminal. Shell 28 also has an opening 74 in the center thereof for threaded member 76. Threaded member 76 extends through opening 74 (FIG. 14) and can be threaded into a portion of holder 30.

Holder 30 is preferably substantially cylindrical and has three apertures or passageways 56, 58 and 60 extending therethrough. Passageways 56 are preferably rectangular and are sized and configured to allow prongs 22 and 24, respectively to pass therethrough. Passageway 60 is generally U-shaped and allows prong 26 to pass therethrough. However, passageways 56, 58 and 60 can be any size and shape that would allow passage of a respective prong or electrical conductor. Additionally, holder 30 has two substantially circular passageways or openings 62 and 64 therein. Passageways 62 and 64 allow screws 66 and 68 to pass therein and into passageways or openings 70 and 72 in the shell 28.

Cover 18 is preferably a plastic or rubber substantially cylindrical member with an outer surface 78 and inner surface 80. Inner surface 80 defines a through passageway that extends the entire length of the cover and has a diameter that allows the holder 30 and shell 28 to be inserted therein. The inner surface 80 can frictional engage a portion of the shell 28 or a portion of both the shell 28 and the holder 30 for improved connection of the plug, if desired, or it can be slightly larger than the diameter of the shell and holder allowing for ease of insertion. Outer surface 78 has grooves or gripping members 82 thereon that substantially surround a portion the outer surface and allow a rough surface for improved gripping when handling the plug. Additionally, inner surface 80 has two threaded openings or passageways (only 86 is shown, see FIG. 2) for accepting threaded members 66 and 68, respectively, to hold plug 12 together and projections 88 for accepting grommet 102.

Figure 13:
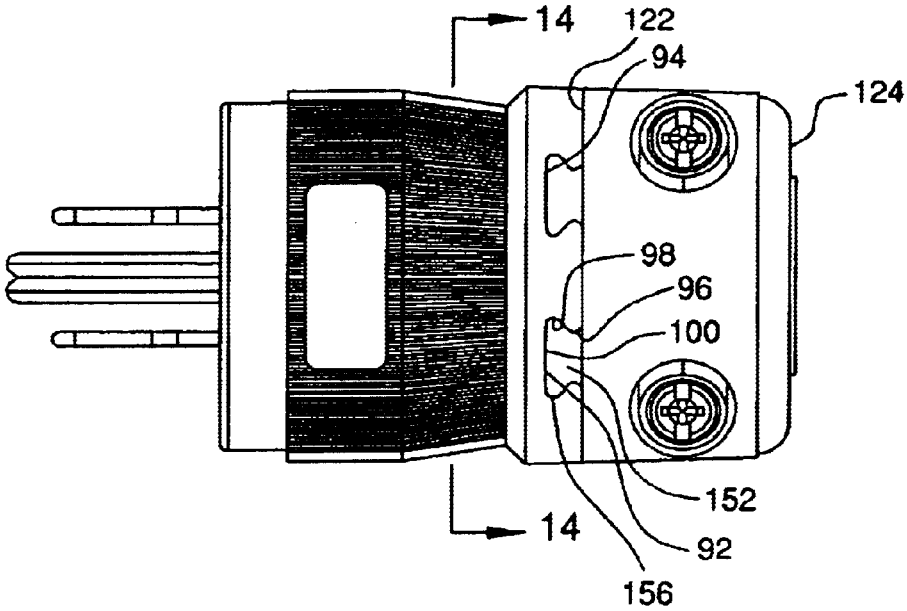
FIG. 13 is a top view of the plug of FIG. 1.

As seen in FIGS. 1, 2 and 13, the rear portion 90 of cover has four grooves or slots 92, 94, 96 and 98. Each groove is substantially similar so only groove 92 will be described in detail herein. As seen specifically in FIG. 13, groove 92 is a dovetail or substantially T-shaped type groove. In other words, the open ended portion 97 of the groove has a width that is less than the width of the closed or base portion or the portion 99 immediately adjacent the wall 100. Each groove has substantially straight walls that extend from the outer surface 78 to the inner surface 80. Furthermore, the walls of grooves 92 and 98 and the walls of grooves 94 and 96 are substantially parallel and along a similar cord.

As seen in FIG. 2, grommet 102 is preferably a substantially cylindrical rubber grommet that has an opening 104 therein for the passage of electrical wiring. Grommet 102 also has a groove 106 that extends around the circumference of the grommet and is configured to allow projections 88 to be inserted thereinto, thus holding grommet 102 with the passageway of cover 18. Furthermore, grommet 102 can have indentations 108 and 110 in its circumference for mating with the protrusions formed by the two threaded passageways in the cover, such as 86.

As seen in FIGS. 2 and 4–7, cord grip 20 is preferably a substantially cylindrical plastic member that includes three separate portions, the upper portion 112, the lower portion 114 and the insertion or insert portion 116. Insert portion 116 is inserted into lower portion 114, which is in turn coupled to upper portion 112 using threaded members 118 and 120. Insert portion 116 has three separate positions that allow it to alter the distance between the insert portion and the upper portion, thereby allowing the cord grip to frictional hold electrical wiring or cords or various diameter or thickness.

Upper portion 112 is preferably a plastic, substantially arcuate member. Upper portion 112 has a first or front surface 122 (FIG. 2) and a back or rear surface 124 (FIG. 1), surfaces 122 and 124 are substantially parallel to each other. Outer surface 126 extends between surfaces 122 and 124 and substantially perpendicular or transverse to each surface. The bottom 128 of upper portion 112 has two separate portions, a first outer portion 130 and a second outer portion 132. Outer portions 130 and 132 are flat or planar portions that extend substantially perpendicular to a tangent proximal to or immediately adjacent a respective surface.

The front and rear surfaces each have a curved inner portion 134 that extends between outer portions 130 and 132. The curved inner portions are defined by two recessed portions 136 and 138 that are immediately adjacent outer portions 130 and 132, respectively, and two protrusions 140 and 142 that extend from the recessed portions. Protrusions 140 and 142 both recede back in the direction of the recessed portions to define a curved surface 144.

Upper portion 112 is generally hollow with a divider or wall 146 that extends substantially perpendicular from the interior surface 148. The bottom portion 150 of divider 146 extends to about or preferably slightly less the bottom 128 of the upper portion and is curved in the same manner as curved portion 134.

Additionally, front surface 122 has two indentations 146 and 148 that engage a protrusion (not shown) on the rear surface of the cover that prevents the upper portion from sliding along grooves 92 and 94 past a predetermined point along the cover 18. In other words, the combination of the protrusion and the indentations aligns the outer surface 126 of the upper portion with the outer surface 78 of the cover 18.

Extending from and along substantially all of front surface 122 are two shaped protrusions 152 and 154, as seen in FIGS. 2 and 13. Each protrusion is substantially similar so only protrusion 152 will be described in detail herein. As seen specifically in FIG. 13, protrusion 152 is substantially the same size as groove 92. Protrusion 152 has a distal portion 156 that is wider than the portion that is immediately adjacent or proximal to surface 122. In other words, protrusion 152 is a dovetail or substantially T-shaped configuration that is adapted to fit with and be held by groove 92.

Figure 4:
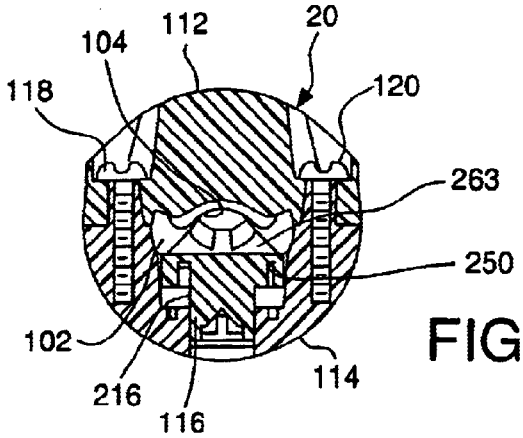
FIG. 4 is an elevational view in cross section of the cord grip of both the connector and the plug of FIG. 1 in the setting for the smallest diameter cable.
Figure 7:
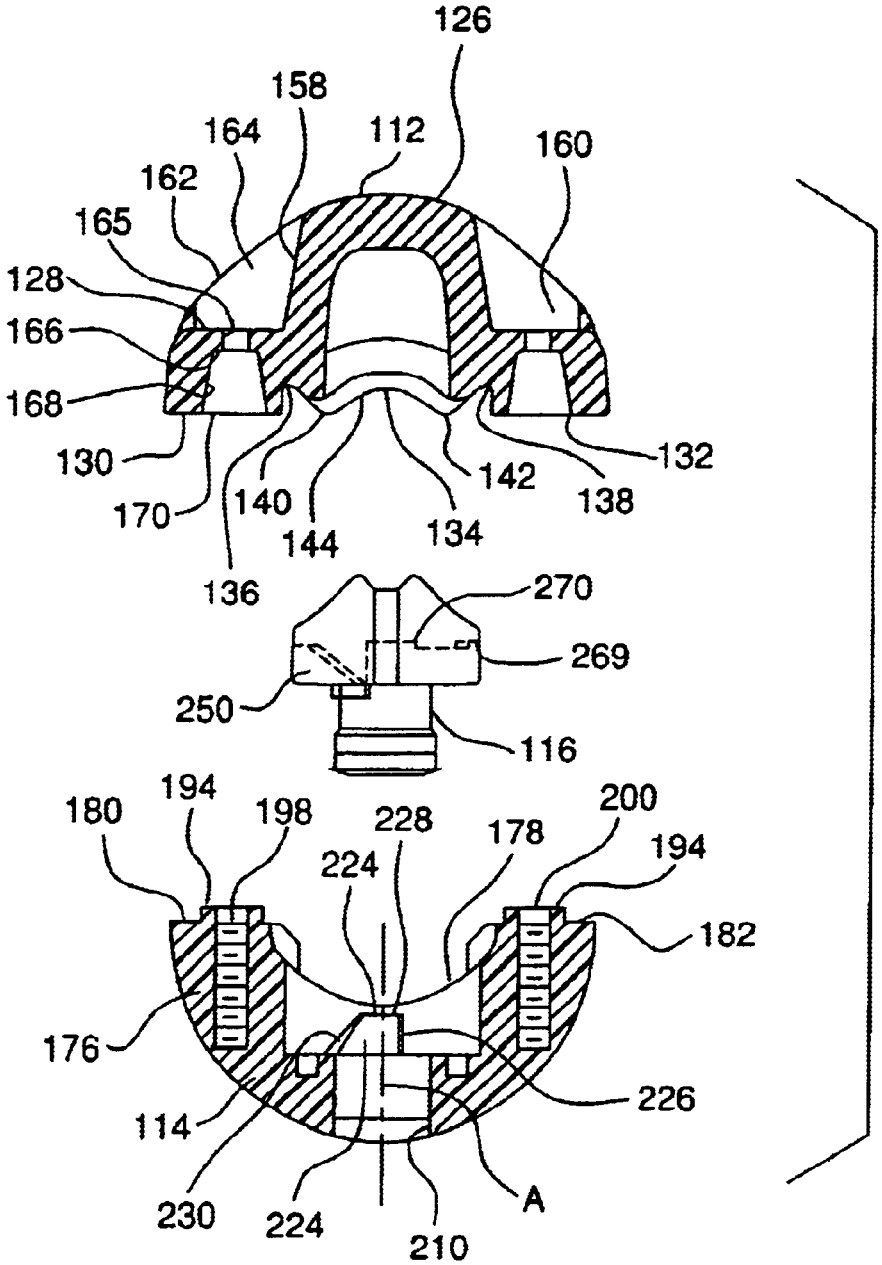
FIG. 7 is an exploded elevational side view in section of the cord grip shown in FIG. 6.

As seen in FIGS. 2, 4 and 7, upper portion 112 has two through passageways 158 and 160 extending from surface 126 to the bottom surfaces 120 and 132, respectively. Each through passageway is substantially similar so only protrusion 158 will be described in detail herein. Through passageway 158 is adjacent opening 162 in surface 126 and is defined by a substantially frustoconical surface 164 that tapers slightly inwardly from the surface 126 to surface 128. Surface 128 reduces the diameter of through passageway 158, where cylindrical surface 165 extends therefrom to surface 166. Surface 165 is preferably a predetermined diameter that would allow threaded member 118 to pass therethrough. Passageway 158 increases in diameter at surface 166, where surface 168 tapers outwardly to opening 170 in surface 130.

Figure 8:
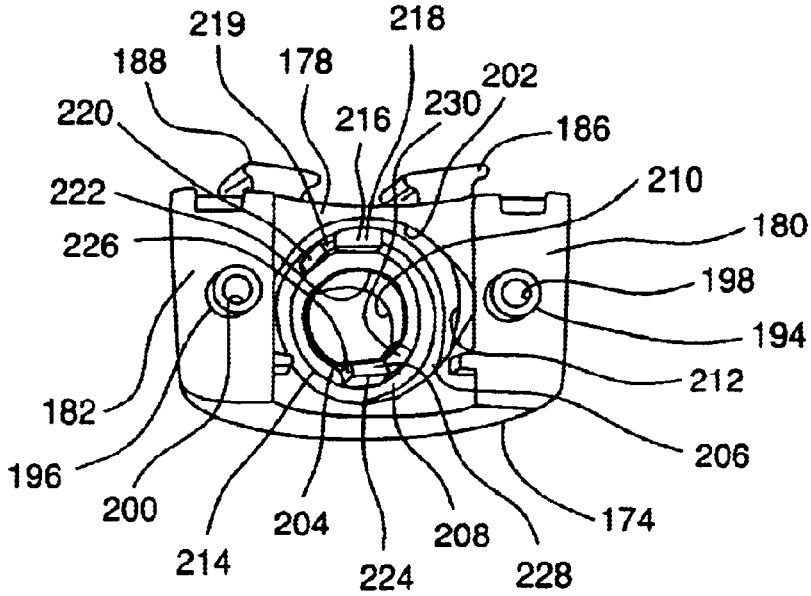
FIG. 8 is a top perspective view of the bottom portion of the cord grip.

As seen in FIGS. 2, 7 and 8, bottom portion 114 is a substantially arcuate or semi-circular portion. In particular bottom portion 114 is a U-shaped member having a front surface 172, a rear surface 174, an outer surface 176, an inner surface 178 and two end surfaces 180 and 182.

Front surface 172 is a substantially U-shaped planar surface with two protrusions 186 and 188 extending therefrom. Protrusions 186 and 188 are dovetail or substantially T-shaped protrusions that are substantially similar to protrusions 152 and 154 and are for the same purpose; i.e. to fit within grooves 96 and 98, respectively. Additionally, surface 172 has two indentations 190 and 192 adjacent end surfaces 180 and 182, respectively. Indentations 190 and 192 are substantially similar to indentations 146 and 148, and engage the same protrusions and serve the same purpose, i.e. to align the outer surface 176 of the lower portion with the outer surface 78 of the cover 18.

Rear surface 174 is a substantially U-shaped planar surface that is substantially parallel to front surface 172 and has about the same shape and surface area.

End surfaces 180 and 182 are both substantially rectangular with a portion of indentations 190 and 192, respectively, extending thereto at the edge adjacent the front surface. Additionally, each end surface has a protrusion 194 and 196, respectively extending therefrom. Each protrusion has a threaded opening or aperture 198 and 200, respectively, for receiving threaded members 118 and 120, respectively. Furthermore, each opening is adapted to engage or fit within the openings 170 in the surface 130 or 132 of upper portion 112. This facilitates assembly of the connector and reduces or eliminates lateral movement of the upper and lower portions relative to one another.

Inner surface 178 is a substantially planar, arcuate surface with a substantially circular opening or aperture 202 therein. Aperture 202 has a central axis A and three substantially circular rings, an inner ring 204, an outer sing 206 and a middle ring 208 that surround substantially circular opening 210, which extends completely through lower portion 114 to outer surface 176.

Outer ring 206 is preferably immediately adjacent the wall 212 that defines aperture 202 and is a substantially planar wall that extends substantially perpendicular to wall 212.

Middle ring 208 is depressed relative to outer ring 206 and inner ring 204, thereby forming a groove 214 that extends around most of ring 208. On one portion of ring 208, preferably adjacent front surface 172, a protrusion 216 extends substantially parallel to wall 212 and the central axis A and beyond ring 206, forming a U-shaped area between wall 212 and the outer surface of the protrusion. Protrusion 216 is arcuate, as it is extends from groove 214. Protrusion 216 has three portions, a substantially rectangular portion 218, a smaller rectangular portion 219 and a slanted portion 220. Portion 218 extends upwardly from groove 214 substantially parallel to wall 212 and beyond ring 206. Portion 218 extends in substantially the same direction, but does not reach the height of surface 178. Additionally, the top surface of the portion 218 is substantially parallel to ring groove 214, while the side surfaces are substantially perpendicular thereto. Smaller rectangular portion 219 is adjacent portion 218 and is in the same configuration as portion 218, but is not quite as high nor as wide. Slanted portion 220 is adjacent portion 219 and at one end is substantially the same height as portion 219, but the top surface slants downward toward groove 214 and away from portion 219 at approximately a 30-degree angle relative to a plane parallel to the groove. When the height of portion 220 reaches the level of ring 206, the slanted portion of 220 ends and a side portion 220 extends substantially perpendicular from groove 214 to the slanted surface.

Figure 10:
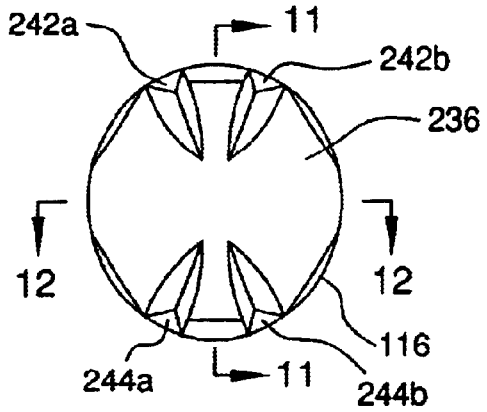
FIG. 10 is a plan top view of the adjustable portion of the cord grip.

Inner ring 204 is about the same height as outer ring 206 and is adjacent wall 222, which defines opening 210. Protrusion 224 extends substantially perpendicularly from ring 204 and substantially parallel with central axis A, preferably adjacent rear wall 174, forming a U-shaped area between the outer surface of protrusion 224 and the wall 212. Protrusion 224 has a first surface 226, a top surface 228 and a slanted or second surface 230. As seen in FIG. 10, first surface 226 extends upwardly substantially parallel with wall 222 to top surface 228. Surface 228 extends substantially perpendicular to surface 226 to slanted surface 230. Surface 230 extends from top surface 228 at about a 60-degree angle to inner ring 204.

As seen in FIGS. 9–12, insert portion 116 is a generally T-shaped insert with a top or upper portion 232 and a bottom or lower portion 234. Upper portion 232 is substantially circular or cylindrical with an upper surface 236, a radial surface 238 and a bottom surface 240. As seen specifically in FIG. 10, upper surface 236 is curved or arcuate and has two sets of protrusions 242*a* and 242*b* and 244*a* and 244*b* extending therefrom.

Figure 9:
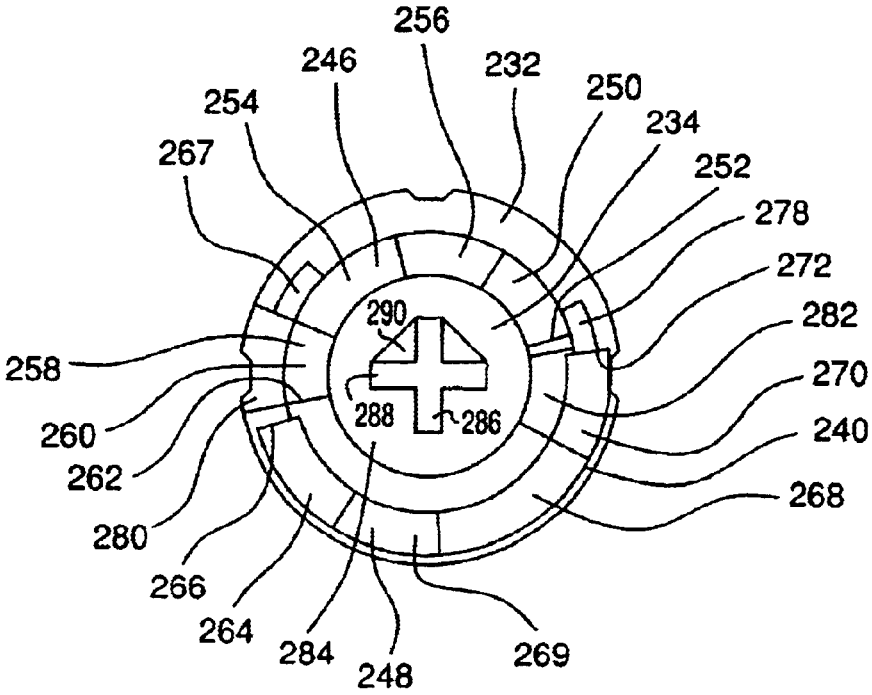
FIG. 9 is a plan bottom view of the adjustable portion of the cord grip.
Figure 11:
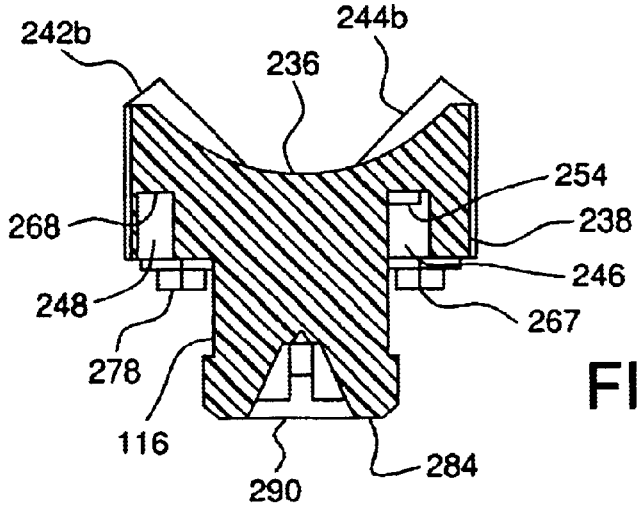
FIG. 11 is an elevational side view of the adjustable portion of the cord grip taken along lines 11—11 of FIG. 10.
Figure 12:
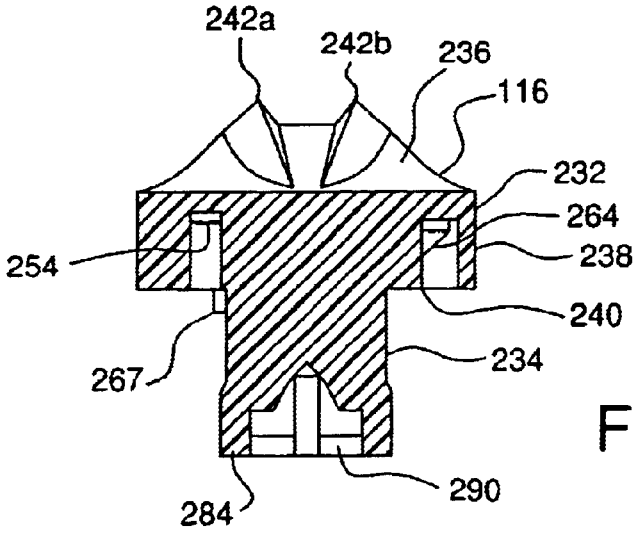
FIG. 12 is an elevational side view of the adjustable portion of the cord grip taken along lines 12—12 of FIG. 10.

As seen in FIGS. 9, 11 and 12, upper portion 232 has two grooves or slots 246 and 248. Slot 246 is adjacent the lower portion 234 or radially closer to the lower portion 234 than slot 248. Slot 246 is arcuate and extends about one half of the way around the upper portion 232; however, slot 246 may be any length desired. Slot 246 has a wall 250 along end 252 that is angled or extends from the bottom 254 of groove 246 at angle other than 90 degrees, such as about 45 degrees. Wall 250 contacts bottom surface 254 adjacent a slight first indented portion or groove 256 in the bottom surface 254. A second indented portion or groove 258 is at end 260 of groove 246 and adjacent end wall 262.

Slot 248 is radially farther from the bottom portion than slot 246. Slot 248 is arcuate and extends about one half of the way around the upper portion 232. As seen specifically in FIG. 12, slot 248 extends about the upper portion on the opposite half than slot 246. Furthermore, slot 248 extends radially outwardly past the point of which slot 246 extends radially inwardly. In other words, the radial distance of the inner side of slot 246 is closer to the lower portion than the radial distance of the outer side of slot 248. Slot 248 has a wall 264 along end 266 that is angled or extends from the bottom 268 of slot 248 at angle other than 90 degrees, such as about 45 degrees. Wall 264 contacts bottom surface 268 adjacent a slight first indented portion or groove 269 in the bottom surface 268. An indented portion or groove 270 is at end 272 of slot 248 and adjacent end wall 274.

End surface 240 has two protrusions 276 and 278 extending therefrom. As seen in FIGS. 9 and 11, each protrusion is preferably rectangular in shape and extends from a portion of the end surface adjacent the slot 246. Furthermore, adjacent protrusion 276 is a first indented portion 280 and proximal protrusion 278 adjacent the lower portion 234 is a second indented portion 282. Each indented portion 276 and 278 is preferably a very minor groove or depression in the bottom surface and is very shallow with respect to the slots 246 and 248; however, the indented portions can be any depth and size desired.

Lower portion 234 is preferably a substantially cylindrical extension that is unitary with the upper portion. However, the lower portion may be a separate piece from the upper portion and attached thereto in any conventional manner, such as adhesive or friction or any other manner suitable. The bottom end of lower portion 234 preferably has a slightly larger diameter than the rest of the lower portion and allows for frictional engagement with the bottom portion 114.

As seen in FIG. 9, surface 284 of lower portion 234 has two intersecting grooves or slots 286 and 288 that are configured to allow use with either a Phillips head screw driver or a conventional flat head crew driver as is know in the art; however, the slots may be configured for use with any tool and not necessarily the screw drivers mentioned above. Furthermore, a substantially triangular recessed portion 290 extends around one end of slot 290 and forms an arrow that can indicate which direction on to turn the insert portion and along with indicia on the housing of the connector (not shown) can indicate which size cable through passageway is set for the insert (i.e. small, medium or large).

Female connector portion 14 is similar to plug 12 and any description thereof applies to female portion 14, except for the contact holder 330 and the contacts 322, 324 and 326. Contact holder 330 is the counter part to blade holder 30, and holder 330 houses contacts 330 therein. Holder 330 is substantially frustoconical with a front surface 340. Front surface 340 is substantially circular and has two substantially rectangular openings 356 and 358 therein and a third larger opening 360, relative to openings 356 and 358 that has an arcuate portion. Openings 356, 358 and 360 are sized and configured to receive a neutral, hot and ground wire as is known in the art, but may be sized and configured to receive any conventional plug configuration and any custom plug configuration. Additionally, surface 340 has two apertures or openings 362 and 364 that are adapted to receive screws 366 and 368, which extend through holder 330 and into threaded openings 70 and 72 of shell 28, coupling the holder 330 and the shell 28 together.

Openings 356 and 358 are aligned with contacts 322 and 324, which are preferably metal contacts that receive prongs 22 and 24, respectively. As seen in FIG. 3, each contact 22 and 24, has three extensions or blades 322*a* and 324*a*, 322*b* and 324*b* and 322*c* and 324*c*, which frictionally engage a respective prong and transfer electricity to and/or from the female connector portion to the plug. Opening 360 is aligned with the ground contact 326, which is also preferably metal and has two blades or extensions 326*a* and 326*b*. The blades frictionally engage a ground prong in the conventional manner.

As with the prongs described above, each contact 356, 358 and 360 has an extension (only extension 325 for contact 358 is shown), respectively that are inserted into box terminals 32, 34 and 36 similar to the extensions on the prongs above.

Assembly

As seen in FIG. 2, grommet 102 is inserted into cover 18, groove 106 receiving protrusions 88. A wire, such as 11 is inserted through opening 104 in grommet 102 and into the interior portion of the cover 18.

Insert portion 116 is inserted into passageway 22 of lower portion 114 and preferably adjusted to the proper size depending on the size of the wire, see FIGS. 4–7. Specifically, lower portion 234 of the insert portion is inserted into the passageway 210 and frictionally engages wall 22. As stated above the insert can be inserted or positioned for three different sized wires or cables.

As shown in FIGS. 1 and 13, the dove tail protrusions 182 and 184 and 186 and 188 of upper portion 112 and lower portion 114, respectively, are inserted or slidably received into dove tail grooves 92 and 94 and 96 and 98, respectively. The distal portions of the protrusions are received with the base portions of the grooves and the proximal portions or the protrusions are received within the open portions of the grooves, thereby coupling the cord grip to the cover. Screws 118 and 120 are inserted into upper portion 112 though passageways 160 and 162 and into the threaded openings 198 and 200 in the lower portion 11, respectively. The insert portion 166 and the curved inner portion 134 frictionally engage the wire 11 holding therebetween.

Figure 14:
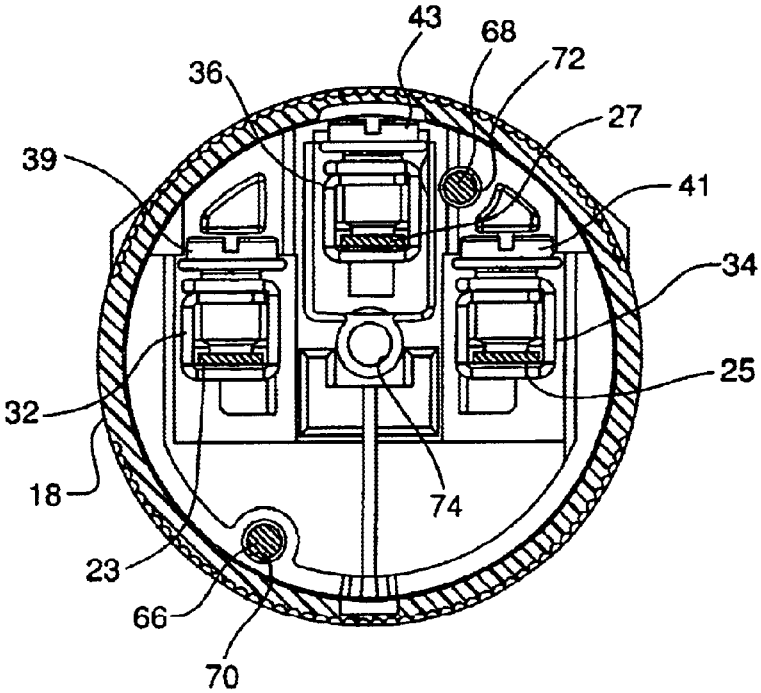
FIG. 14 is an end view in cross section of the plug of FIG. 16 taken along lines 14—14.

Extensions 23, 25 and 27 on prongs 22, 24 and 26, respectively, are inserted into box terminal passageways 33, 35 and 37, respectively. The box terminals are then inserted into indented portions 51, 53 and 55 and a respective wire is inserted through the shell 28 and into a box terminal, as shown in FIG. 14. Respective screws 39, 41 and 43 are inserted into the bottom of the box terminals, each in the same direction as each other screw and the prongs and the wires are electrical coupled and held within the box terminals in the conventional manner.

Blade holder 30 is coupled to shell 28 by inserting prongs 22, 24 and 26 into apertures 26, 28 and 60, respectively and then inserting screw 76 through the back of shell 28, which is then threaded into holder 30. Once the holder and the shell are coupled together the screws for the box terminal can still be accessed through the openings formed by arcuate walls 44, 46 and 48 and the matching arcuate walls in the holder (not shown). This allows connection of the electrical wires, if not performed already or adjustment or reconnection thereof.

Housing 16 is then inserted into the cover 18, with screws 66 and 68 passing through apertures 62 and 64, respectively and threading into an openings in the cover 18, such as 86.

Female connector portion 14 is assembled in substantially the same manner, except the contacts 322, 324 and 326 are merely aligned with openings 356, 58 and 360, respectively.

To complete electrical connection, the prongs of the plug are then inserted into a respective opening in the female connector portion and into a respective contact.

By forming an electrical connector in this manner the connector is easily and securely assembled. Furthermore, the insert can be adjusted to three differing positions by rotating the insert relative of the upper and lower portions, thus the cord grip can frictionally engage cords of differing diameters.

Operation of the Cord Grip Insert

If the cord grip is assembled or during assembly, the cord grip insert can be rotated to allow three different electrical wire or cable diameters to be friction held in the cord grip. As seen in FIG. 4, the distance between the cord grip insert 116 and the upper portion 112 of the cord grip 20 is at its smallest, thus allow frictional engagement of relatively small electrical cords. In this position the higher portions of the U-shaped surface 236 is along the path of the electrical cord. The cord would lie between the protrusions 242*a* and 242*b* and 244*a* and 244*b* and be compressed between the protrusions and the upper portion 112. Protrusions 216 and 224 on the lower portion 114 engage indentions 280 and 282 (FIG. 9) on the bottom surface 240 of the insert 116. By engaging the indentations, the insert portion is locked into place and will not rotate relative to the cord or the cord grip.

Figure 6:
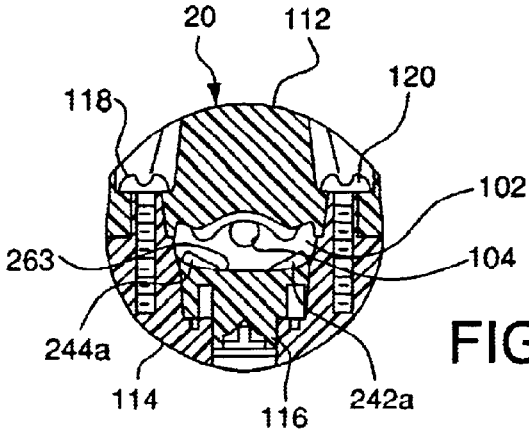
FIG. 6 is an elevational view in cross section of the cord grip of both the connector and the plug of FIG. 1 in the setting for the largest diameter cable.

Using a screwdriver or other device, the insert portion 116 can be moved axially and rotated 90 degrees clockwise when looking at the bottom of the insert portion, as shown in FIG. 12. The insert portion is prevented from moving counterclockwise since protrusion 267 on the bottom of the insert engages the side of protrusion 216. By moving the insert portion axially, the protrusions 216 and 224 disengage from the indentations 280 and 282 and by rotating the insert portion 90 degrees the protrusions 216 and 224 transverse angled surfaces 264 and 250, respectively. When a force is applied in the direction of the top of the insert to the bottom, the angled surfaced 264 and 250 will allow the insert to move downwardly relative to the lower portion 114, protrusions 216 and 224 extending into slots 248 and 246, respectively. As the insert continues to turn in the clockwise direction, the protrusions 216 and 224 engage indentations 269 and 256, respectively, locking the insert's movement relative to the cord and the lower portion 114. This position is seen in FIG. 6 and is the position that would allow the largest cord to extend through the cord grip and into the cover.

The cord would extend across the lower portions of U-shaped surface 236 and the sides of the cord would be laterally held by the protrusions 242*a* and 242*b* and 244*a* and 244*b*. Additionally, cord would frictionally engage the protrusions and the surface 263 and the upper portions 112.

Figure 5:
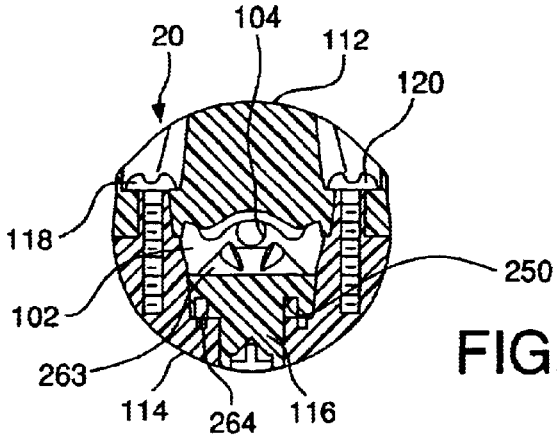
FIG. 5 is an elevational view in cross section of the cord grip of both the connector and the plug of FIG. 1 in the setting for a medium diameter cable.

If a screwdriver or other tool is then used to turn the insert portion 116 again axially and 90 degrees clockwise, as viewed from FIG. 9, the protrusions 216 and 224 disengage from the indentations 269 and 256. The protrusions 216 and 224 traverse the slots 248 and 246, respectively and engage indentations 270 and 258, respectively, locking the insert's movement relative to the cord and the lower portion 114. This position is seen in FIG. 5 and is the position that would allow a medium sized cord to extend through the cord grip and into the cover.

The cord would be gripped in a substantially similar manner as to that of the first herein described cord grip insert position, except that the insert sits in a higher position relative to the lower portion, since protrusions 216 and 224 engage indentations on the bottom surface 240 rather than in the slots 248 and 246.

Furthermore, the insert is prevented from moving further in the clockwise position, since protrusion 278 on the insert engages the side of protrusion 216. The insert can only turn counter clockwise and back to the positions described above.

It is noted that the insert 116 can be rotated in any direction desired and not necessarily in the manner described above. Furthermore, the directions up, down, clockwise, upper lower, etc. and the description of the one member relative to another, such as one member is higher than another, is for description of the device and is not meant to limit the device to any particular orientation or specific configuration.

While a particular embodiment has been chosen to illustrate the invention, it will be understood by those skilled in the art that various changes and modifications can be made therein without departing from the scope of the invention as defined in the appended claims.

What is claimed is:

1. An electrical connector, comprising:

a housing having a front face with first and second openings therein, said first and second openings receiving first and second electrical prongs, respectively;

a cord grip coupled to said housing and having a first portion, a second portion and an insert portion;

said second portion having a substantially cylindrical passageway with a center axis therein and a first protrusion extending within said passageway substantially parallel to said center axis;

said insert portion being insertable within said passageway and rotatable relative to said second portion, said insert portion having first, second and third indentations and first, second and third positions relative to said second portion;

wherein said first protrusion is adapted to engage said first, second or third indentations when said insert portion is rotated to said first, second and third fixed positions thereby allowing electrical cords of at least three differing diameters to be frictionally held by said cord grip.

2. An electrical connector according to claim 1, wherein said protrusion engages an angled surface on said insert portion, thereby changing the axial position of said insert portion when moving said insert portion from said second position to said third position.

3. An electrical connector according to claim 1, wherein said insert portion has a groove that receives said protrusion when said insert portion is rotating from said first position to said second position.

4. An electrical connector according to claim 3, wherein said groove has an angled wall that engages said protrusion, thereby changing the axial position of said insert portion when moving said insert portion from said second position to said third position.

5. An electrical receptacle, comprising:

a housing having a front surface with first and second openings therein, said first and second openings receiving first and second electrical prongs from an electrical plug, respectively;

a cover having a periphery and first and second ends, said first end having an opening therein, said opening receiving at least a portion of said housing therein, and said second end and having a first groove extending from said periphery toward the center of the cover, said first groove having a base portion and a open portion, said base portion being wider than said open portion; and a cord grip having a first portion, a second portion and an insert portion, a first protrusion extending from said first portion and having a proximal portion and a distal portion, said distal portion being wider than said proximal portion;

said first protrusion being slideably received with said first groove with said distal portion being received within said base portion and said proximal portion being received within said open portion, thereby coupling said cord grip to said second end of said housing; and said cord grip insert portion being rotatable to three different fixed positions and having three indentations being engaged by said first protrusion, thereby allowing electrical cords of at least three differing diameters to be frictionally held by said cord grip.

6. An electrical receptacle according to claim 5, wherein said cord grip has a first surface and said protrusion extends along substantially all of the width of said first surface.

7. An electrical receptacle according to claim 5, further comprising:

a second groove on said cover having a base portion and an open portion, said base portion being wider than said open portion; and a second protrusion on said cord grip having a proximal portion and a distal portion, said distal portion being wider than said proximal portion;

wherein said second protrusion is slideably received in said second groove.

8. An electrical connector, comprising:

a housing having a front face with first and second openings therein, said first and second openings receiving first and second electrical prongs, respectively;

first, second and third box terminals coupled to said housing using first, second and third fastening members, respectively, said fastening members being inserted into said housing from substantially the same direction;

first and second electrical contacts at least partially received in said first and second box terminals, respectively, and mechanically and electrically coupled to said first and second electrical prongs, respectively; and a cord grip coupled to said housing and having an insert, said insert capable of being adjusted to at least three different fixed positions and thereby allowing electrical cords of three differing diameters to be frictionally held by said cord grip.

9. An electrical connector according to claim 8, further comprising first and second substantially T-shaped coupling members unitarily attached to said cord grip and adapted to couple said cord grip to said housing.

10. An electrical connector according to claim 9, wherein said housing has two slots, said first T-shaped coupling member is slideably received within slots on said housing, and said second T-shaped coupling member is slideably received within the other of said slots on said housing.

11. An electrical connector according to claim 8, wherein said first box terminal is electrically connected to a hot electrical lead, said second box terminal is electrically connected to a neutral electrical lead and said third box terminal is electrically connected to a ground.

12. An electrical connector according to claim 8, wherein said first and second electrical prongs are unitary with said first and second electrical contacts and extend from said electrical housing through said first and second openings in said front face of said housing.

13. An electrical connector according to claim 8, wherein said first and second electrical prongs are received through said first and second openings in said front face of said housing and couple to said first and second electrical contacts.

14. An electrical receptacle, comprising a housing having a front surface with first, second and third openings therein, a rear surface, a first side and a second side, said first, second and third openings receiving first second and third electrical prongs from an electrical plug, respectively;

first, second and third box terminals coupled to said housing using first, second and third fastening members, said first, second and third fastening members being inserted through first, second and third apertures in said first side of said housing and extending into said first, second and third box terminals;

a cord grip having a substantially T-shaped coupling member unitarily attached thereto, said substantially T-shaped coupling member being slideably received within a slot on said rear surface of said housing, coupling said cord grip to said housing;

an electrical cord extending through said cord grip and said rear surface of said housing and electrically connecting to said first, second and third fasteners in said first, second and third box terminals; and first, second and third electrical contacts, each having first, second and third ends, said first end of said first, second and third electrical contacts at least partially received in said first, second and third box terminals, respectively, and electrically connected to said electrical cord and said second end of said first, second and third electrical contacts receiving said first, second and third electrical prongs, respectively.

15. An electrical receptacle according to claim 14, wherein said cord grip insert is adjustable to three different fixed positions, thereby allowing electrical cords of at least three different diameters to be frictionally held by said cord grip.

16. An electrical receptacle according to claim 15, wherein said cord grip insert is rotated to achieve one of said three different positions.

17. An electrical receptacle according to claim 15, wherein said first box terminal is electrically connected to a hot electrical lead, said second box terminal is electrically connected to a neutral electrical lead and said third box terminal is electrically connected to a ground.

18. An electrical plug for an electrical connector, comprising a housing having a front face with first and second openings therein, said first and second openings receiving first and second electrical prongs, respectively;

first and second electrical contacts unitarily coupled to said first and second electrical prongs, respectively;

first, second and third box terminals coupled to said housing using first, second and third fastening members, each of said fastener members being inserted into said housing from substantially the same direction as each other fastening member;

a cord grip having a substantially T-shaped coupling member unitarily attached thereto, said substantially T-shaped coupling member being slideably received within a slot on said rear surface of said housing, coupling said cord grip to said housing;

a cord grip insert capable of being adjusted to at least three different positions and thereby allowing electrical cords of differing diameters to be frictionally held by said cord grip;

an electrical cord frictionally engaging said cord grip and said cord grip insert and extending through said rear surface of said housing and electrically connecting to said first and second fasteners in said first and second box terminals;

first, second and third box terminals coupled to said housing using first, second and third fastening members, each of said fastener members being inserted into said housing from substantially the same direction as each other fastening member.

19. An electrical plug according to claim 18, wherein said first box terminal is electrically connected to a hot electrical lead, said second box terminal is electrically connected to a neutral electrical lead and said third box terminal is electrically connected to a ground.

20. An electrical plug according to claim 18, wherein said first and second electrical contacts are at least partially received in said first and second box terminals, respectively.

21. An electrical plug according to claim 18, wherein said cord grip insert is adjustable to three different positions, thereby allowing electrical cords of at least three different diameters to be frictionally held by said cord grip.

* * * * *